United States Patent [19]

Gunther

[11] 4,202,458

[45] May 13, 1980

[54] DEVICE TO CONTROL EVAPORATION LOSSES FROM LIQUID HOLDING STORAGE TANKS

[76] Inventor: Arnold Gunther, 29 Lorelei Rd., West Orange, N.J. 07052

[21] Appl. No.: 969,176

[22] Filed: Dec. 13, 1978

Related U.S. Application Data

[63] Continuation-in-part of Ser. No. 871,806, Jan. 24, 1978, abandoned.

[51] Int. Cl.[2] ..... B65D 89/04; B65D 89/16

[52] U.S. Cl. ..... 220/85 B; 48/176; 220/216

[58] Field of Search ..... 220/85 B, 216, 227; 48/176, 177, 178

[56] References Cited

U.S. PATENT DOCUMENTS

| | | | |
|---|---|---|---|
| 1,631,959 | 6/1927 | Glass | 220/216 |
| 2,050,459 | 8/1936 | Pease | 220/216 |
| 2,050,686 | 8/1936 | Wiggins | 220/216 |
| 2,074,959 | 3/1937 | Guest | 220/216 |
| 2,408,539 | 10/1946 | Wiggins | 220/216 |
| 2,486,823 | 11/1949 | Granmer | 220/216 |
| 2,578,090 | 12/1951 | Plummer | 220/85 B |
| 2,601,317 | 6/1952 | Moyer | 220/227 |
| 2,624,490 | 1/1953 | Fino | 220/85 B |
| 2,670,873 | 3/1954 | Whidden | 220/85 B |
| 3,228,702 | 1/1966 | Ulm | 220/85 B |

FOREIGN PATENT DOCUMENTS

| | | | |
|---|---|---|---|
| 106097 | 12/1938 | Australia | 220/85 B |

*Primary Examiner*—George E. Lowrance

[57] ABSTRACT

A cylindrical, open top, collapsible container is loosely fitted inside the tank. The bottom of this container floats on the liquid and its lateral surface folds or unfolds upon the rise or fall in the liquid level. The annular gap between the container and the tank's shell is connected to a bladder. The bladder is expanded or contracted in the required amounts by mechanical linkages between the floating bottom and said bladder.

2 Claims, 3 Drawing Figures

DEVICE TO CONTROL EVAPORATION LOSSES FROM LIQUID HOLDING STORAGE TANKS

This application is a continuation-in-part of Ser. No. 871,806 filed Jan. 24, 1978 and now abandoned.

BACKGROUND OF THE INVENTION

Devices of the prior art, utilized to decrease the evaporation losses emanating from liquids contained in storage tanks, and which are mainly due to filling, emptying and "breathing" of these tanks, comprise floating roofs, blankets, variable vapor space enclosures and conservation vent valves. The first class consists of, as its name implies, a metallic structure which is essentially a pan floating on the surface of the liquid that has sealing means between the periphery of the pan and the tank's shell. Because it is practically impossible to effect a tight closure of the gap between the pan's pheriphery and the tank's shell, due to the shell out of roundness and other imperfections, the evaporative losses experienced with this type of devices are very substantial.

Blankets are thin, plastic sheets usually built with a cellular structure to decrease their density, which allows them to float on the liquid surface. Here again, the coverage of the liquid surface by the blankets is never complete and consequently the evaporative losses sustained are substantial. The variable vapor space class consists of a flexible diaphragm of suitable materials (elastomers impregnated fabrics, as an instance) contained in a metallic tank, which in turn is sometimes located over the roof of the storage tank or is located independently outside of the storage tank. Means are provided to connect the vapor space in the storage tank with the variable space container. The storage tank vapor space now linked with the variable vapor container define a variable vapor space.

The variation in volume allowed by the movement of the flexible diaphragm controls most of the tank's breathing losses, but does not control the venting loss due to filling and emptying operations.

Vent conservation devices are essentially check valves set at somewhat higher and lower pressures than the normal atmospheric pressure, the setting depending on the allowable stresses for the tank's shell.

Here again, the main function of these devices is to control a certain extent the breathing losses, but are not suitable for the control of the venting loss due to filling and emptying operations.

Other devices of the prior art, which were intended to decrease substantially the losses experienced by the floating roofs, consists of cylindrical curtains attached to the periphery of a floating disc, pan, or similar structure and to the tank's shell, usually to the top portion of the shell.

These cylindrical curtains are concentrical to the tank's shell, and are kept apart from it by a relatively narrow annular gap.

Although this type of devices would provide a very efficient control of the evaporative loss, they are seldom, if ever, used in practice, mainly for reasons that will become apparent below.

Glass: U.S. Pat. No. 1,631,959, Plummer: U.S. Pat. No. 2,578,090, Champagnat: French Pat. No. 1,116,444 exemplify this class of devices. In the devices of Glass and Plummer the gas contained in the annular gap tends to be compressed when the liquid level in the tank rises. The compressed gas will exert pressure on the curtains which, by collapsing inwardly, keep the gas volume constant.

In the device of Champagnat, the compressed gas inflates an expandable container, thereby keeping the total volume of gas constant. Theoretically the total amount of gas should remain substantially constant at all times. But in practice, due to unavoidable losses caused by imperfect sealing at the attachment of the vertical liners or curtains to the tank and floating disc, pin-holes in the materials of construction for this liners, etc, the gas which is under a slight pressure leaks out and thus gradually decreases the amount of gas therein contained.

When the liquid level in the tank descends, the gas available to fill the gap is insufficient and consequently a vacuum is created.

The atmospheric pressure acting on the liners pushes and holds them tightly against the tank's shell and as the liquid continues to descend, the forces holding the liners against the shell restrain the free descent of the floating disc, which literally hangs up. Part or all of the weight of the floating disc is thereby supported by the liners which generates stresses of enough magnitude to induce failure of the same.

SUMMARY OF THE INVENTION

The present invention deals with devices that substantially eliminate all evaporation losses emanating from the operation of liquid holding storage tanks and thus fulfills two objectives: product conservation and air pollution abatement.

A main objective is to provide devices that overcome the shortcomings of the prior art and thus render reliable storage tank operation.

The storage tanks contemplated in the present invention operate at essentially atmospheric pressure. The size of these tanks vary from about 20 feet to 300 feet in diameter and from about 20 feet to 80 feet in height.

They are cylindrically shaped and may or may not have a fixed roof. In the cases where a fixed roof is not present, they are usually fitted with a floating roof.

These tanks can withstand only small pressure differentials across their walls. which requires venting of any excess of the vapors and or gases that would tend to increase the tank's internal pressure over the safe limit.

In the present invention a cylindrically shaped, closed bottom, open top, collapsible container is loosely fitted into the storage tank's shell.

The bottom of this container floats on the liquid stored in the tank, and it is attached and sealed by its top rim to the corresponding top portion of the shell. The diameter of the collapsible container is slightly smaller than the shell diameter, and the relatively narrow annular gap between them is filled with the vapors emanating from the stored liquid and a gas (usually air). The mixture of the vapors and the gas exert a total pressure which is equal to the prevailing atmosphere pressure.

The total pressure being the sum of the partial pressure of the stored liquid, which depends on its temperature, and the partial pressure of the gas.

The cylindrical portion of the collapsible container, commonly known as a vertical liner, is built out of a thin and flexible material, such as plastics, rubber, etc., that folds when the container collapses, which occurs when the liquid level in the tank rises, and conversely, unfolds when the liquid level descends.

The bottom of the collapsible container may be fabricated out of the same type of materials as above mentioned, or any other convenient material that is chemically inert to the liquid stored.

For materials that have a higher specific gravity then the liquid stored, buoyancy is provided by proper design of the shape of these bottoms or by providing pontoons or similar buoyancy means.

The storage tank is divided by the collapsible container into two regions:

a. the region comprised between the internal surface of the tank and the external surface of the collapsible container. This region contains the narrow annular gap before mentioned, the liquid stored, and any gas pockets trapped between the liquid surface and the bottom of the collapsible container.

b. the region comprised between the internal surface of the collapsible container and the tank's roof. This region is filled with atmospheric air.

Any changes in the liquid level will cause contraction or expansion of the b region and only air will be displaced from the container into the surrounding atmosphere or vice versa.

The annular gap volume changes with the displacements of the liquid level, it is at its maximum volume for the lowest level selected for the operation of the storage tank and at its minimum volume for the highest working level.

The change in volume of the gap would entail an increase in the pressure of the gas contained therein for an upward displacement of the liquid level, which, if uncontrolled, would cause the vertical liner to inflate or "to be ballooned" towards the interior of the tank. This would impair the folding of the liner that, in turn would decrease the available storage capacity of the tank.

These undesirable effects are avoided by providing auxiliary variable volume containment means, connected to the annular gap by convenient means.

Although the shape and location of these variable volume containment means, that in what follows will be called bladders for reasons of brevity, are arbitrary and in practice, for a better utilization of the storage tank capacity, a cylindrical container having a large diameter to height ratio is preferred. The cylindrical portion of these bladders is built out of a relatively thin and flexible material, which in the majority of the cases is the same as the one used in the vertical liners construction.

Changes in the volume of gas contained in these bladders will cause their cylindrical portion to fold or unfold. In certain instances, when thicker and stiffer materials are used, the cylindrical portion is built precorrugated or bellows shaped to facilitate its expansion and contraction.

These expandable containers which are generally located inside the storage tank, may be supported from the tank's roof or they may be supported on the floating bottom of the collapsible container.

In either case they are connected by convenient means to the annular gap. When supported from the tank's roof, only the top of the bladder is attached by convenient means to the roof, which allows the bladder to freely expand and contract in the vertical direction.

Similarly, when supported on the floating bottom, only the floor of the bladder is conveniently attached leaving it free to expand and contract in the vertical direction.

The volume enclosed by the bladders when fully expanded is made equal to, or preferably larger than the volume comprised in the annular gap between the high and low liquid levels.

In the large size tanks here considered, the gasketing or other sealing means used in the attachment of the loose liners to the tank are by necessity, substantially long. Also the liners are built by sealing juxtaposing panels, usually 3 to 5 feet in the width, which is the commercial size width for the rolls of plastic or rubber used in their construction.

To convey an idea of the sealing lengths involved: a collapsible container for a tank 100 feet in diameter and 40 feet in height has approximately 4000 lineal feet of seals.

Assurance of perfect sealing throughout is not achievable in practice and consequently these liners will be subjected to leakage when a pressure differential is applied across them.

In order to convey a clear understanding of the consequences of such a leakage, the operation of the storage tanks will be described in some detail.

Starting with the liquid in the tank at its lowest operating level, the annular gap will be at its maximum volume and the bladder will be at its minimum volume. Pumping liquid into the tank will cause the vertical liner to fold which will in turn decrease the volume of the annular gap. Gas flows from the gap to the bladder which will increase its volume by an amount equal to the decrease of volume in the gap.

When the liquid level reaches the highest operating level, the volume of the gap is, for the present purpose, zero, and the volume of the bladder is at least equal to the volume of the gap at the start of the filling operation. Considering now the case where the bladder is attached to the floating bottom, the weight of the unsupported portion of the bladder, i.e.: its cylindrical envelope and its circular top, will pressurize the gas contained therein, which will cause it to flow back into the gap at a rate determined by the rate of leakage through the liners.

In practice, after a tank has been filled, it may remain full for an extended period of time before partial or total withdrawals are made. The bladder has thus ample time, considering its relatively small volume, to become empty, or totally contracted.

Upon the withdrawal of the liquid, there is no gas available in the bladder to fill the annular gap, and consequently a vacuum develops in this space which causes the atmospheric pressure acting on the liner to push and hold it tightly against the tank or shell.

The friction forces so developed restrain the bottom of the collapsible container from descending, which literally hangs-up when its weight is smaller than the friction forces holding the liner, or it will cause the liner to slide over the shell when its weight is larger than the friction forces.

In the first case the stresses developed in the liner may exceed its tensile strength and cause failure of the same.

In the second case, the sliding of the liner over the rough surface of the shell may cause it to suffer cuts and other damages that will render it unusable. In either case, the effects are of catastrophic nature.

Consider now the case where the bladder is supported from the tank's roof, in which the weight of the unsupported and freely hanging portion of the bladder will tend to expand it and consequently decrease the pressure of the gas contained therein.

The decrement of pressure is relatively small due to the lightness of the materials of construction. To illustrate this point, a bladder built out of 30 mils thick polyethylene sheet (1 mil=0.001 inch) will generate a pressure decrement of about 0.001 psi.

In the absence of leakage through the liners, the bladder's volume would remain constant as long as the liquid level in the tank remains unchanged.

But, due to the unavoidable imperfections of the seals as explained before, the small pressure differential between the gas contained in the bladder and the atmosphere is sufficient to draw air and cause the bladder to become fully expanded after a period of time, at which point the weight of its hanging portion is fully supported and consequently the pressure differential vanishes. A raise on the liquid level will now cause the gas contained in the annular gap, which can not be displaced into the now fully expanded bladder to inflate or "balloon-up" the liner with the consequences explained before.

In the present invention, support means, that cancel the weight of the unsupported portions of the collapsible bladders at any position of the liquid level in the tank, are provided. Thus the undesirable effects before described are totally avoided and a reliable storage tank operation is assured.

The detailed description and operation of the support means will be better understood by reference to the drawings and the detailed description that follows.

BRIEF DESCRIPTION OF THE DRAWINGS

Reference is now made to the drawings.

DETAILED DESCRIPTION

Figure 1:
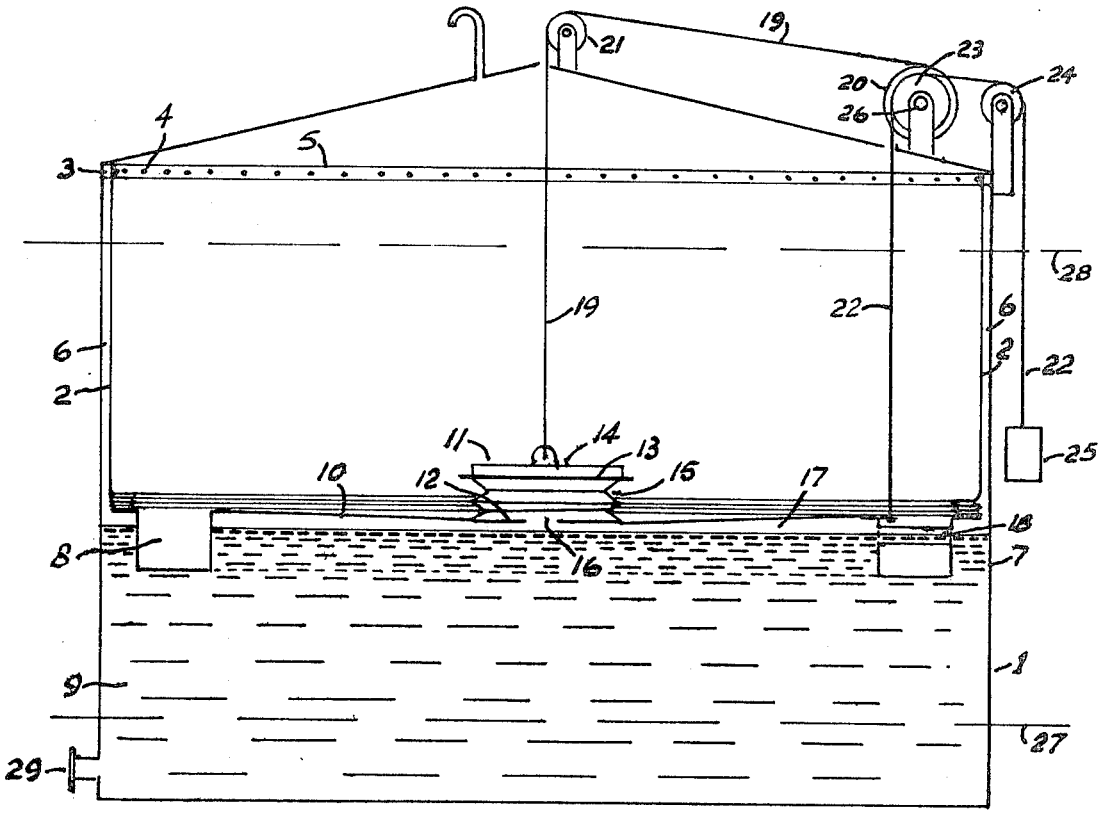
FIG. 1 is a semi-diagrammatic vertical section of a typical embodiment in which the bladder is supported on the floating bottom.

In FIG. 1, the storage tank is indicated with numeral 1.

The cylindrical liner 2, which fits loosely inside the tank and leaves an annular gap 6 between itself and the shell 7, is attached to the upper portion of the tank's shell. A gasket 3, interposed between the shell and the liner and kept under compression through the agency of a set of bolts 4 and circular strip 5, provides a seal for the gas contained in the annular gap 6.

The lower end of the liner 2 is attached to a circular trough 8 which floats on the liquid 9 contained in the tank. Convenient sealing means, such as glueing or gasketing, for example, are provided at the attachment area to prevent flow of gas into or out of the gap 6.

A circular membrane 10 is also attached and sealed to the circular trough 8. The liner 2, trough 8 and membrane 10 constitute a collapsible container that will partially or totally collapse, by folding its liner 2 when the liquid level raises.

A collapsible bladder 11 is attached to the membrane 10. This bladder takes the shape of a flat cylinder or prism with its base 12 forming part of the membrane 10 and its top 13 attached to a rigid frame 14.

The side wall 15 of the bladder is made out of a relatively thin and therefore easily foldable material.

When a thicker or stiffer material is used, the sidewall is fabricated with the corrugations built into it.

The height of the bladder, when at its maximum volumetric capacity, is sized to be compatible with the clearance available below the tank's roof when the liquid is at its highest working level. The volume change in the bladder between its minimum volume (which will occur at the liquid low working level), and its maximum volume (which will occur at the liquid high working level) is equal to the volume of the annular gap 6 comprised between the above liquid levels.

An opening 16 communicates the contents of the bladder with the gas pocket 17 trapped between the membrane 10 and the liquid surface. Ducts 18, in turn communicate the gas pocket 17 with the gap 6.

The weight of the bladder is supported by the cable 19 which is attached to the frame 14 by one end and to the drum 20 by the other end.

Sheave 21 is only intended to provide the required change of direction for the cable 19.

The chain 22 is attached to the circular trough 8 and rides over the sprockets 23 and 24. The chain is kept taut by the counterweight 25.

The sprocket 23 and drum 20 rotate about the same axis as shaft 26 to which they are firmly held by convenient means, such as a common keyway and key for example.

The operation of the device will now be described.

We shall assume that the liquid level is at its low point 26 at the start of the operation.

The bladder 11 is now collapsed at its minimum volume.

As the liquid is pumped into the tank through nozzle 29, the circular trough 8 rises with the liquid level, the liner 2 folds and the counterweight 25 pulls the chain 22 causing the drum 20 to rotate (clockwise in the present case). The cable 19 wraps around the drum 20, and raises the frame 14, increasing the volume of the bladder.

The volume increase in the bladder is made to coincide substantially with the corresponding volume decrease in the annular gap by proper sizing of the bladder, and therefore when gas is transferred from the gap to the bladder as the liquid level rises, the pressure of the gas remains substantially at atmospheric pressure. When the liquid reaches the high level 28 the bladder has been expanded to its maximum volume and the gap has attained its smallest volume. Nearly all of the gas contained in the gap has flowed into the bladder. The liner is now nearly fully folded. The circular trough and the base of the bladder have travelled a distance equal to the one comprised between the low and high liquid levels, whereas the bladder's top 13 has travelled in addition a length equal to its expansion in the vertical direction. The excess length of travel required for the top 13 or frame 14 is obtained by making the pitch diameter of the drum 20 larger than the pitch diameter of the sprocket 23. The following formula expresses concisely the required relationship for the speed change required:

$$D_1/D_2=(L+E)/L$$

Where:

$D_1$ is pitch diameter of the drum 20

$D_2$ is pitch diameter of the sprocket 23

L is vertical distance between high and low liquid level

E is total vertical expansion of the bladder

The weight applied by the bladder to the cable 19 is balanced by providing a somewhat larger weight to the counterweight 25.

The turning moment around the axis 26, generated by the tension that cable 19 applies on the drum 20, is thus balanced by a turning moment of opposite sign, generated by the tension that chain 22 applied on the sprocket 23.

In practice the weight 25 is made larger than the one required to equilibrate the weight of the bladder. The excess weight generates tension in the portion of the chain 22 that links the sprocket and floating trough 18 and keeps the chain taut.

It may now be realized that, at any position of the liquid level and at all times, the effect of the bladder's weight on the pressure of the gas contained therein is cancelled, thus avoiding the shortcomings mentioned earlier in the specifications.

Figure 2:
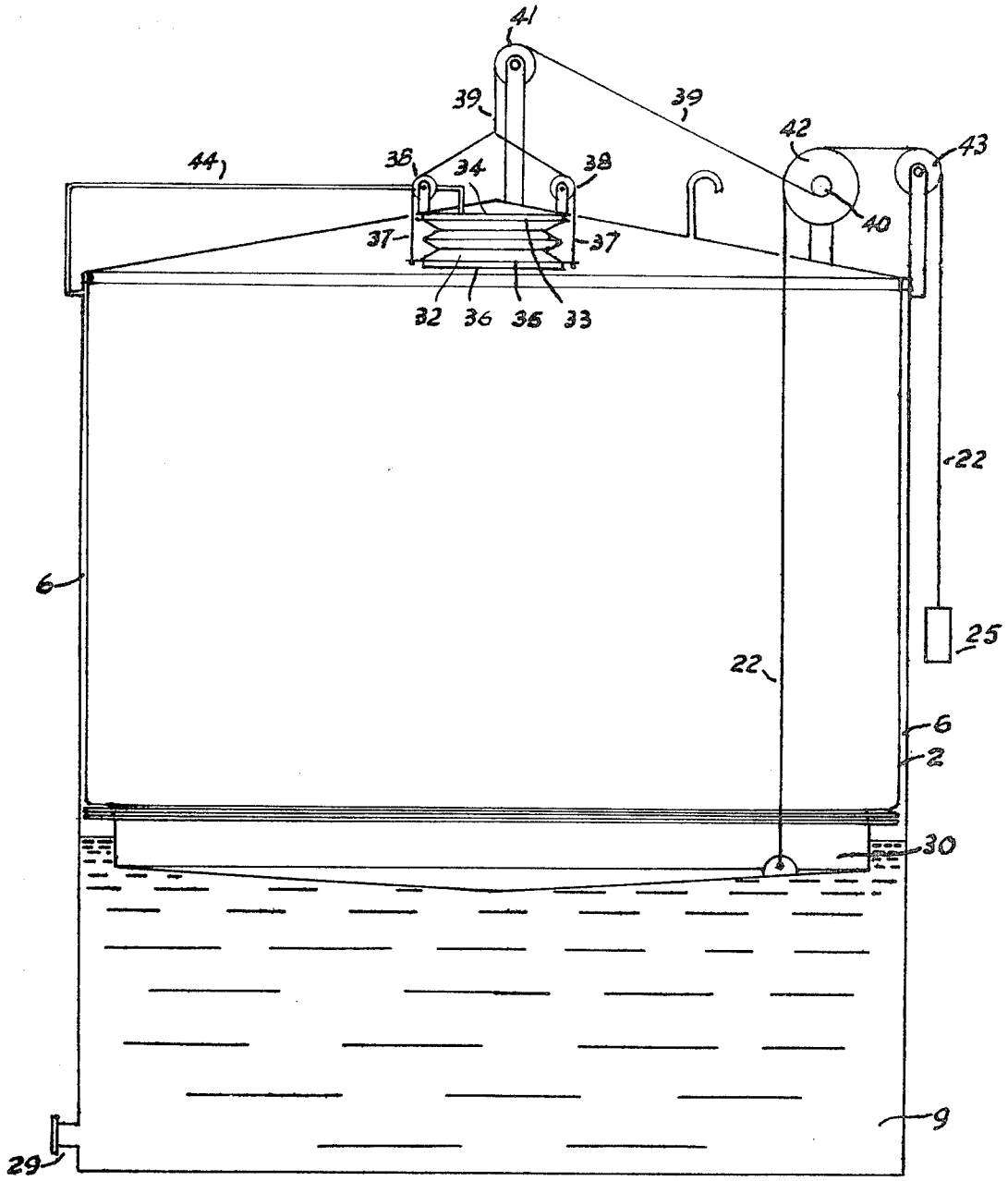
FIG. 2 is a semi-diagrammatic vertical section of a typical embodiment in which the bladder is supported from the tank's roof.

For the operation of the device when the collapsible bladder is supported from its top to the roof of the tank, reference is now made to FIG. 2.

In the embodiment represented here, the floating bottom of the collapsible container has been shown as a metallic floating pan 30.

The floating pan has attached and properly sealed to its periphery the liner 2. The bladder 32 has its top 33 attached to a frame 34 which in turn is attached to the roof by convenient means, such as welding or bolting, for example.

The base 35 of the bladder is attached or it may form part of the rigid frame 36. The gas contained in the bladder is in communication with the gas in the annular gap 6 through conduit 44.

Guide cables 37, usually three of such cables are provided, are hooked to the frame 36 and after changing their direction at the sheaves 38, are joined in a single cable 39, which rides over sheave 41 and it wraps over drum 40.

A sprocket 42 is concentrical with the drum 40 and is rigidly connected to it by convenient means, such as a common shaft keyway, for example.

Chain 22, which is hooked to the pan 30, rides over sprockets 42 and 43 and is kept taut by a counterweight 25.

The operation of the embodiment just described is similar to the one depicted by FIG. 1, the only important difference being the direction of travel for the free portions of the bladders relative to the tank.

Whereas in FIG. 1 the bladder expands upwardly for an increase in the liquid level, in the present case it expands downwardly. The required change of direction is achieved by wrapping the cable 39 around drum 40 in the proper sense, which in the particular case shown in FIG. 2 is counterclockwise.

It will be now remarked that other configurations for the bladder or a variable capacity container are readily achievable.

Figure 3:
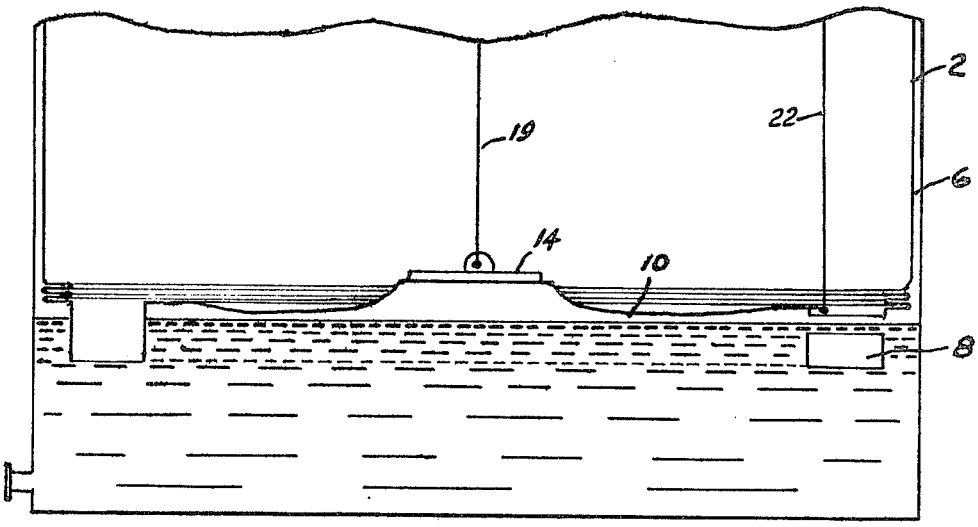
FIG. 3 is a semi-diagrammatic partial vertical section of a typical embodiment depicting an alternate variable volume container.

FIG. 3 illustrates the case where the bladder is substituted for a variable capacity container defined by the membrane 10 and the surface of the liquid. The rigid frame 14, now attached directly to the membrane 10, will provide through its vertical displacements, the required volumetric changes.

Having thus described the present invention in its preferred embodiments, it will be apparent to those skilled in the art that other embodiments will attain the same objectives without departing from the scope of this invention.

I claim:

1. A device to control evaporation losses from liquid holding storage tanks comprising, in combination, a. a liquid holding storage tanks, b. a cylindrical, open top, closed bottom, thin walled, collapsible container, loosely fitting into said tank and occupying substantially said tank volume, the top portion of said container being fastened and sealed to the upper portion of said tank's shell, the bottom of said container floating on the liquid contained in said tank, c. a variable capacity container capable of expanding and contracting in the vertical direction and having its weight supported by counterweighing means, d. a chain riding over a sprocket, fastened by one of its ends to the bottom of said collapsible container and by the other end to said counterweighing means, a drum which rotates about the same axis as the said sprocket, a cable with one of its ends wrapped around said drum and by its other end fastened to said variable capacity container, e. connecting means between said variable capacity container and the annular gap comprised between said tank's shell and said collapsible container.

2. A device to control evaporation losses from liquid holding storage tanks as claimed in claim 1, in which the said variable capacity container is substantially constituted by a flexible membrane facing the surface of the liquid contained in said tank and forming part of the bottom of said collapsible container, and the surface of said liquid.

* * * * *